US011466895B2

(12) United States Patent
Fukui et al.

(10) Patent No.: US 11,466,895 B2
(45) Date of Patent: Oct. 11, 2022

(54) EXTERIOR CASE FOR HOT WATER UNIT

(71) Applicant: NORITZ CORPORATION, Hyogo (JP)

(72) Inventors: Nobuhiro Fukui, Hyogo (JP); Hiroshi Fujii, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 237 days.

(21) Appl. No.: 16/137,516

(22) Filed: Sep. 20, 2018

(65) Prior Publication Data

US 2019/0093920 A1 Mar. 28, 2019

(30) Foreign Application Priority Data

Sep. 25, 2017 (JP) ..... JP2017-183446
Nov. 28, 2017 (JP) ..... JP2017-228109

(51) Int. Cl.
*F22B 31/00* (2006.01)
*H02G 3/14* (2006.01)
(Continued)

(52) U.S. Cl.
CPC ..... *F24H 1/181* (2013.01); *F24D 19/0097* (2013.01); *F24H 9/02* (2013.01)

(58) Field of Classification Search
CPC ..... F25D 23/02; F25D 23/028; B21D 39/03; B21D 53/04; F28F 3/00; F22B 31/00; F22B 31/08; F24H 9/06; F24H 1/181; F24H 1/182; H02G 3/081; H02G 3/14; H02G 3/04; H01F 7/021; H01R 43/26; H01H 11/00
See application file for complete search history.

(56) References Cited

U.S. PATENT DOCUMENTS 2,084,287 A * 6/1937 Handley ..... F22B 9/04 122/18.1
4,780,573 A * 10/1988 Own ..... H02G 3/14 174/66

(Continued)

FOREIGN PATENT DOCUMENTS

CN 1616241 5/2005
CN 1647943 8/2005

(Continued)

OTHER PUBLICATIONS

"Office Action of China Counterpart Application", dated Apr. 2, 2021, with English translation thereof, p. 1-p. 14.

(Continued)

*Primary Examiner* — Gregory A Wilson
(74) *Attorney, Agent, or Firm* — JCIPRNET

(57) ABSTRACT

Provided is an exterior case for a hot water unit which can be produced in a simple operational process with high productivity and with low costs without environmental pollution even if a complex pattern or the like is formed, in which the overall design properties are favorable. There is provided an exterior case used for accommodating a hot water device for hot water production or hot water storage therein, and an ink jet printing layer representing at least one of letters, symbols, figures, and patterns is provided on a paint layer of a metal plate constituting the exterior case.

10 Claims, 10 Drawing Sheets

(51) Int. Cl.

| | |
|---|---|
| ***F24H 1/18*** | (2022.01) |
| ***F24D 19/00*** | (2006.01) |
| ***F24H 9/02*** | (2006.01) |

(56) References Cited

U.S. PATENT DOCUMENTS

| | | | | | |
|---|---|---|---|---|---|
| 4,800,239 | A * | 1/1989 | Hill | H02G 3/14 | 174/66 |
| 5,594,208 | A * | 1/1997 | Cancellieri | H02G 3/10 | 439/535 |
| 5,675,125 | A * | 10/1997 | Hollinger | H02B 1/26 | 174/66 |
| 6,807,729 | B2 * | 10/2004 | Kawashima | B32B 5/18 | 29/831 |
| 6,977,342 | B1 * | 12/2005 | Maltby | H02G 3/14 | 174/67 |
| 7,119,278 | B1 * | 10/2006 | Shotey | H02G 3/14 | 174/67 |
| 7,622,676 | B2 * | 11/2009 | Drane | H02G 3/14 | 174/67 |
| 7,699,026 | B2 * | 4/2010 | Gordon | F24H 9/02 | 122/19.2 |
| 7,763,799 | B2 * | 7/2010 | Johnson | H02G 3/088 | 174/67 |
| 8,653,364 | B2 * | 2/2014 | Roban | H02G 3/14 | 174/66 |
| 9,222,696 | B2 * | 12/2015 | Lesage | F24H 1/08 | |
| 10,054,361 | B2 * | 8/2018 | Kim | G06F 3/0412 | |
| 10,105,745 | B2 * | 10/2018 | Adams | B21D 22/20 | |
| 10,507,489 | B2 * | 12/2019 | Satou | E04F 13/08 | |
| 10,516,256 | B2 * | 12/2019 | Segro | H02G 3/10 | |
| 2012/0297621 | A1 * | 11/2012 | Kuo | F24H 1/181 | 29/890.14 |
| 2013/0048653 | A1 * | 2/2013 | Boltshauser | B23D 21/00 | 220/679 |
| 2016/0271974 | A1 * | 9/2016 | Giammarco | B44C 1/14 | |
| 2017/0110862 | A1 * | 4/2017 | Kirkland, III | H02G 3/14 | |
| 2018/0264776 | A1 * | 9/2018 | Wang | B32B 5/18 | |
| 2019/0093920 | A1 * | 3/2019 | Fukui | F24H 1/181 | |
| 2019/0162445 | A1 * | 5/2019 | Fukui | B21D 5/00 | |

FOREIGN PATENT DOCUMENTS

| | | | | |
|---|---|---|---|---|
| CN | 1803473 | | 7/2006 | |
| CN | 202163049 | | 3/2012 | |
| CN | 209484850 | | 10/2019 | |
| JP | 10297197 | A * | 11/1998 | |
| JP | H10296906 | | 11/1998 | |
| JP | H11294867 | | 10/1999 | |
| JP | 2012032029 | | 2/2012 | |
| JP | 2014040950 | | 3/2014 | |
| JP | 2014102004 | A * | 6/2014 | F24D 11/0214 |
| JP | 5893878 | | 3/2016 | |

OTHER PUBLICATIONS

Office Action of Japan Counterpart Application, with English translation thereof, dated Aug. 17, 2021, pp. 1-9.

* cited by examiner

30
INK JET PRINTING
4 (4f)
4 (4b)
4 (4c)
4 (4f)
4 (4a)
D1
D2
D3
4 (4e)
4 (4d)
4 (4f)
30
4 (4f)
HEAT
HEAT
4 (4a)
4 (4f)
4 (4b)
4 (4c)
4 (4f)
4 (4e)
4 (4d)
4 (4f)
4 (4f)
SUCH AS HOLE PROCESSING
D3
4 (4f)
4 (4f)
D3
4
33
32
30
D3
4 (4f)
DRAWING PROCESS
D3
35
4
36
3
34
34
D3
D3

EXTERIOR CASE FOR HOT WATER UNIT

CROSS-REFERENCE TO RELATED APPLICATION

This application claims the priority benefit of Japan Applications No. 2017-183446 and No. 2017-228109, respectively filed on Sep. 25, 2017 and Nov. 28, 2017. The entirety of each of the above-mentioned patent applications is hereby incorporated by reference herein and made a part of this specification.

BACKGROUND

Technical Field

The disclosure relates to a hot water unit in which a hot water device for hot water production or hot water storage, for example, a water heater and a cogeneration system, is accommodated in an exterior case and an exterior case thereof.

Description of Related Art

As specific examples of a hot water unit configured as a water heater, for example, there are hot water devices which are configured to perform hot water heating using combustion gas generated by a burner and which are accommodated in an exterior case (for example, refer to Patent Document 1 (Japanese Laid-open No. 2012-32029), Patent Document 2 (Japanese Laid-open No. H11-294867), and Patent Document 3 (Japanese Laid-open No. 2014-40950)). Such exterior cases for a hot water unit are generally produced by pressing a colored steel plate having a monochromatic surface.

In such a hot water unit, various types of device related information such as a manufacturer name, a distributor name, a model, and a manufacture date are displayed on the exterior case. In this case, in the related art, a method in which a label on which device related information is printed is prepared and the label is attached to the exterior case is used.

However, according to the related art, attaching a label is troublesome, and it cannot be said that the productivity is favorable. When there are many types of labels, there is a risk that an operator may make a mistake regarding an attachment position. In addition, there is a risk that bubbles may enter between the label and the exterior case or a part of the label may peel off, and the appearance may deteriorate. The entire label may peel off and be lost.

In order to address the above circumstances, it may be conceived that device related information is displayed by, for example, printing using a transfer system. According to such a method, it is possible to eliminate circumstances occurring when the label is attached. Moreover, the above printing cannot be said to be favorable in terms of workability, and there is room for improvement in terms of better productivity. In addition, in the case of device related information including small letters and many letters and device related information with complicated figures such as an electrical wiring diagram, it is difficult to display the information legibly or clearly (for example, refer to Patent Document 4 (Japanese Laid-open No. H10-296906), Patent Document 5 (Japanese Patent No. 5893878)).

On the other hand, in such a hot water unit, in addition to displaying letters or symbols representing, for example, a manufacturer name, a type or capabilities of the hot water unit, on the exterior case, it may be required to make a large area of a front surface of the exterior case in a predetermined color different from the background color of the front surface of the colored steel plate. In this case, in the related art, after component parts (an exterior case main body and a cover body) of the exterior case are formed by press molding, the component parts are painted by a spray system. A solvent paint or a powder paint may be used as the paint.

However, in the above related art, as will be described below, there is room for improvement.

That is, when a painting method using the spray system of the related art is used, in addition to troublesome masking processing on an uncoated part and paint color matching, a paint spraying operation using a spray gun (air gun) is also troublesome and expert skills are also required. Therefore, the workability and productivity are poor. In addition, since paint is also sprayed onto a masking part, there is much waste of paint. Therefore, production costs of the exterior case and production costs of the hot water unit are high.

Such circumstances become significant when patterns to be painted are more complicated and the number of colors increases, and it is difficult to express fine patterns. Further, when a solvent paint or a powder paint as a spray paint is used, the environmental load is large, and it is difficult to maintain a favorable state of an operation environment and appropriately perform a paint disposal process.

Here, in the related art, a painting method using a transfer system may be appropriately used. However, according to the painting method using this system, a transfer plate is necessary and high costs are incurred. In addition, it is unsuitable for painting a large area.

SUMMARY

An exterior case for a hot water unit provided according to a first aspect of the disclosure is an exterior case for a hot water unit used for accommodating a hot water device for hot water production or hot water storage therein, wherein the exterior case is formed using a metal plate, and a paint layer is provided on at least one of an outer surface and an inner surface of the metal plate, and wherein an ink jet printing layer that is laminated and provided on the paint layer and represents at least one of letters, symbols, figures, and patterns is provided.

Here, the ink jet printing layer is a print layer formed by spraying ink droplets in the form of fine liquid droplets onto a painting target area using an ink jet printer.

Other features and contents of the disclosure will become more apparent based on the following description of embodiments of the disclosure with reference to the appended drawings.

DESCRIPTION OF THE EMBODIMENTS

Figure 1A:
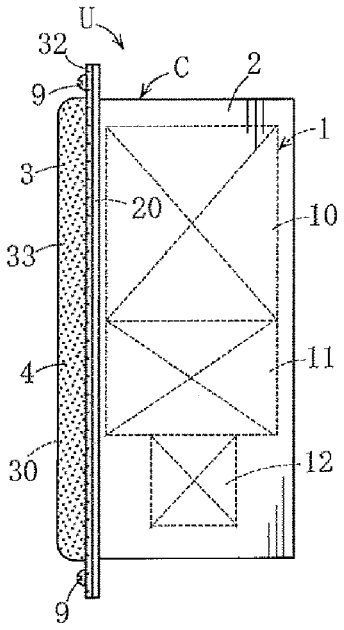
FIG. 1(*a*) is a side view showing an example of a hot water unit according to an embodiment of the disclosure and FIG. 1(*b*) is an exploded perspective view of an exterior case (when an internal hot water device is omitted) of the hot water unit shown in FIG. 1(*a*).

The embodiments of the disclosure provide an exterior case for a hot water unit which can be produced in a simple operational process with high productivity and with low costs without environmental pollution even if a complex pattern or the like is formed, in which the overall design properties are favorable, and in which device related information can be easily and appropriately displayed, and a hot water unit including the same.

The embodiments of the disclosure provide the following technical aspects.

In such a configuration, the following can be obtained.

That is, since the ink jet printing layer is additionally provided on the paint layer provided on at least one of an outer surface and an inner surface of the metal plate constituting the exterior case, it is possible to appropriately represent desired letters, symbols, figures, and patterns. As the metal plate on which the paint layer is provided, for example, a colored steel plate can be used without change. On the other hand, the ink jet printing layer can be easily provided using an ink jet printer, and unlike painting using the spray system of the related art, masking processing on the exterior case and paint color matching are not performed and expert skills are not required. In addition, unlike painting using the transfer system of the related art, a transfer plate is not used and it is easy to paint a large area. Therefore, it is possible to improve workability of painting and increase productivity for the exterior case. In addition, since the ink jet printing layer can be provided only at a desired part, it is possible to eliminate or reduce waste of the ink paint. As a result, it is possible to reduce production costs of the exterior case and production costs of the hot water unit.

In addition, according to the ink jet printing layer, since it is possible to finely represent patterns with complex shapes or patterns in which many colors are used, it is more suitable for improving an external appearance of the hot water unit. In addition, compared with the related art, it is possible to reduce the environmental load and easily realize a favorable state of the operation environment.

In the exterior case for a hot water unit according to one or some exemplary embodiments of the disclosure, on the ink jet printing layer, device related information of the hot water unit is displayed.

In such a configuration, the following can be obtained.

First, since device related information is displayed using the ink jet printing layer, it is possible to eliminate a need to attach a label for displaying device related information to the exterior case. Therefore, it is possible to appropriately eliminate circumstances occurring when a label attachment operation is used, that is, circumstances such as a complicated label attaching operation, a poor appearance due to bubbles that have entered under the label or peeling off of a part of the label, or loss due to peeling off of the label.

Second, the ink jet printing layer can be easily provided using an ink jet printer. For example, unlike a painting method using a transfer system, paint color matching and a transfer plate are not performed. In addition, it is easy to paint a large area. Therefore, it is possible to improve workability of painting, increase productivity for the exterior case, and reduce production costs of the exterior case.

Third, according to ink jet printing, it is possible to represent small letters and complicated figures finely and legibly. In addition, since the ink jet printing layer is provided on the paint layer, letters displayed on the ink jet printing layer can be made clear and it is possible to improve an appearance of the exterior case.

In one or some exemplary embodiments, on the ink jet printing layer, a decoration pattern is additionally displayed in addition to the device related information.

Such a configuration is more suitable for improving the appearance of the exterior case. In addition, compared with a case in which a decoration pattern is provided using, for example, a painting method using a transfer system or a spray system, results such as improved productivity and low production costs can be obtained.

In one or some exemplary embodiments, as the metal plate part, an exterior case main body of which at least one surface has an opening and a cover body that is attached to the exterior case main body so that it blocks the opening are provided, and the ink jet printing layer is provided on at least one of the exterior case main body and the cover body.

In one or some exemplary embodiments, as the ink jet printing layer, an ink jet printing layer which is provided on a front part of the cover body and on which at least one of a manufacturer name, a distributor name, a model, a manufacture date, and instructions for use of the hot water unit is displayed as the device related information is provided.

In one or some exemplary embodiments, as the ink jet printing layer, an ink jet printing layer on which at least one of an electrical wiring diagram and a piping diagram of the hot water unit and other diagrams for explaining installation of parts is displayed as the device related information is provided.

The exterior case for a hot water unit according to one or some exemplary embodiments of the disclosure has a drawn part, and within the drawn part, in a part in which a plate thickness of the metal plate is thinner than other parts, a thickness of the ink jet printing layer is thinner than other parts.

In such a configuration, the following can be obtained.

That is, after the ink jet printing layer is provided on the exterior case, when the drawn part is provided, if the thickness of the entire ink jet printing layer of the drawn part is large and uniform, there is a risk of the ink jet printing layer peeling off at a part (within the drawn part, a part in which a plate thickness is thinner than other parts) in which an amount of the metal plate drawn is large. On the other hand, according to the above configuration, it is possible to appropriately avoid such risks.

In the exterior case for a hot water unit according to one or some exemplary embodiments of the disclosure, a burring hole having a burring part protruding from the drawn part is provided, and in the burring part, an ink jet printing layer connected to an ink jet printing layer provided on a part surrounding the burring hole is provided.

In such a configuration, it is possible to paint the part surrounding the burring hole and the burring part in colors or patterns connected continuously, and it is possible to make an external appearance of the part favorable. Unlike the above configuration, when the ink jet printing layer is provided, for example, only on the part surrounding the burring hole, and no ink jet printing layer is provided on the burring part, there is a risk that the burring part may appear as an unnatural part from the outside. However, according to the above configuration, it is possible to eliminate such circumstances.

In one or some exemplary embodiments, at least a part of component parts of the exterior case for a hot water unit according to the disclosure are press working articles. A marker for positioning when the component parts are pressed is provided in the ink jet printing layer.

In such a configuration, when the component parts of the exterior case are formed by pressing, it is possible to perform press processing using a marker for positioning represented on the ink jet printing layer as a reference. Therefore, it is possible to accurately position letters and patterns represented on the ink jet printing layer and a processed part subjected to press processing so that they do not deviate greatly from each other.

In one or some exemplary embodiments, the ink jet printing layer contains a UV curable resin.

In such a configuration, it is possible to quickly cure the ink jet printing layer by emitting ultraviolet rays. Therefore, for example, during ink jet printing, it is possible for ink jet printing to proceed while ultraviolet rays are emitted to the ink jet printing layer and the ink jet printing layer is cured. When a new ink jet printing layer having a different color is provided in an area adjacent to the uncured ink jet printing layer, there is a risk of occurrence of bleeding. However, when ink jet printing proceeds while the ink jet printing layer is cured by emitting ultraviolet rays as described above, it is possible to prevent the above bleeding from occurring.

In one or some exemplary embodiments, the ink jet printing layer contains a thermosetting resin.

In such a configuration, after the ink jet printing is completed, when the ink jet printing layer is heated and the thermosetting resin is cured, it is possible to increase the strength of the ink jet printing layer and impart excellent weather resistance.

Exemplary embodiments of the disclosure will be described below in detail with reference to the drawings.

Example 1

Figure 1B:
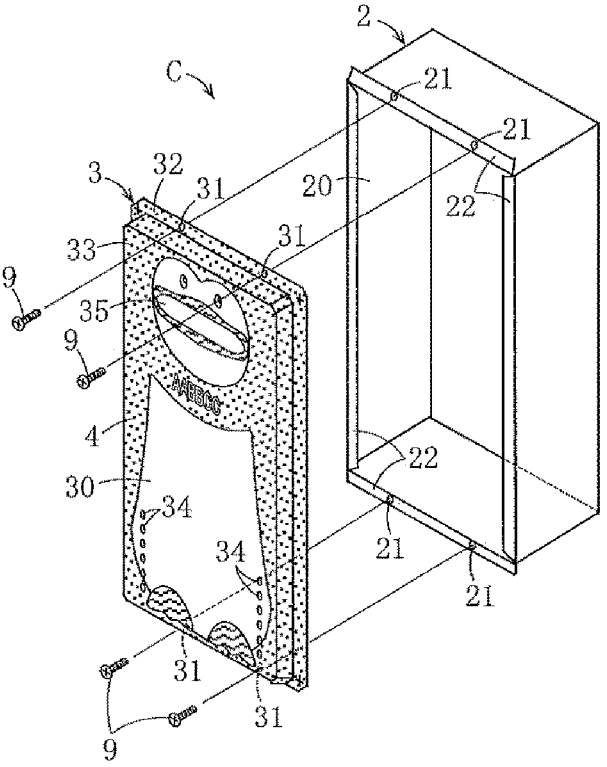

A hot water unit U shown in FIG. 1 is a water heater, and has a configuration in which a hot water device 1 for hot water production is accommodated in an exterior case C. The hot water device 1 includes a heat exchanger 10 through which hot water flows, a burner 11 configured to heat hot water in the heat exchanger 10, and a fan 12 configured to supply combustion air to the burner 11.

The exterior case C includes a rectangular box-shaped exterior case main body 2 having an opening 20 on its front surface and a cover body 3 (front cover body) for blocking the opening 20. The cover body 3 is detachably attached to a front part of the exterior case main body 2 using a screw body 9, for example, a screw, and screw insertion holes 31 and 21 into which the screw body 9 is inserted.

In the present embodiment, an ink jet printing layer 4 (in the drawing, part marked with a dot pattern or a wavy line pattern) is provided on the cover body 3, but it is not provided on the exterior case main body 2. Therefore, hereinafter, a configuration of the cover body 3 will be described in detail and the exterior case main body 2 will not be described. However, as will be described below, of course, an ink jet printing layer may be provided on the exterior case main body 2.

The cover body 3 has a configuration in which the ink jet printing layer 4 (4*a* to 4*g*) is provided on a press-molded colored steel plate 30 (corresponding to an example of a metal plate on which a paint layer is provided) to be described below. However, when the cover body 3 in the present embodiment is produced, as will be described below, after the ink jet printing layer 4 is provided on the colored steel plate 30, press processing is performed.

The cover body 3 has a substantially rectangular panel shape in a front view and includes an outer peripheral flange part 32 and a bulging part 33 that is surrounded by the outer peripheral flange part 32 and bulges forward (to the front side of the exterior case C) from the outer peripheral flange part 32. The outer peripheral flange part 32 is a part which abuts a substantially rectangular frame-like flange part 22 provided on the front part of the exterior case main body 2. As shown in FIG. 3(*a*), a folded part 32*a* is connected to an outer edge part thereof by hemming processing.

Figure 2A:
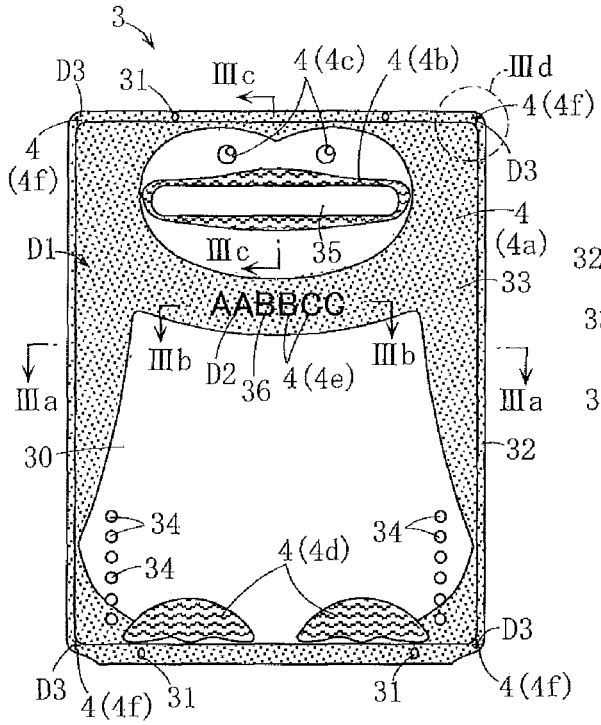
FIG. 2(*a*) is a front view of a cover body of the exterior case shown in FIG. 1 and FIG. 2(*b*) is a front view of the cover body shown in FIG. 2(*a*) in which an ink jet printing layer is omitted.
Figure 2B:
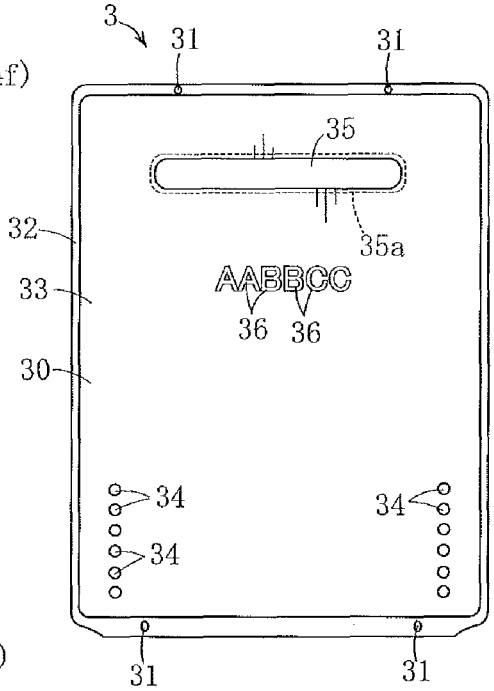
Figure 3A:
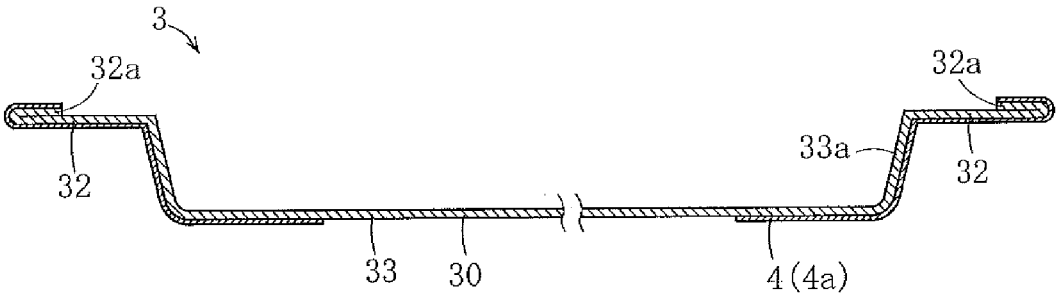
FIG. 3(*a*) is a cross-sectional view taken along the line IIIa-IIIa in FIG. 2(*a*), FIG. 3(*b*) is a cross-sectional view of a main part taken along the line in FIG. 2(*a*), FIG. 3(*c*) is a cross-sectional view of a main part taken along the line IIIc-IIIc in FIG. 2(*a*), and FIG. 3(*d*) is a front cross-sectional view of a part indicated by a reference numeral IIId in FIG. 2(*a*).
Figure 3B:
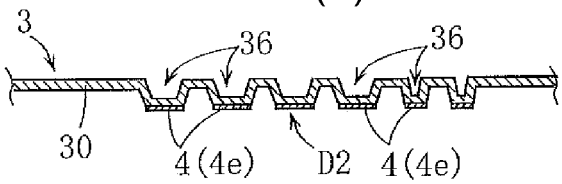
Figure 3C:
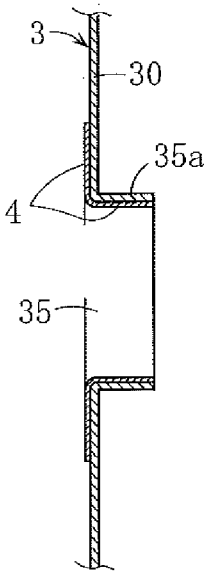
Figure 3D:
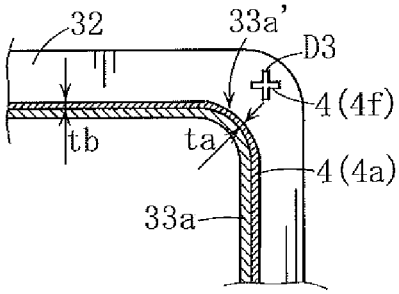

The bulging part 33 of the cover body 3 occupies most of the cover body 3, and an air supply port 34 and an exhaust port 35 are provided in the bulging part 33 (refer to FIG. 2). The air supply port 34 is a part that enables outside air to flow into the exterior case C. The exhaust port 35 is a part for discharging exhaust gas from which heat recovery by the heat exchanger 10 has been completed to the outside of the exterior case C, and as shown in FIG. 3(*c*), is formed as a burring hole in which a tubular burring part 35*a* is connected to its peripheral edge part. Similarly to the exhaust port 35, the air supply port 34 can be formed as a burring hole.

As will be described below, the ink jet printing layer 4 is a coating layer provided by using an ink jet printer 8. As an ink for ink jet printing, a water-based pigment ink or a solvent-based pigment ink can be used. However, in the present embodiment, an ink containing a UV curable resin, and a thermosetting resin is used.

As the ink jet printing layer 4 provided on a front surface of the cover body 3, for example, the ink jet printing layers 4*a* to 4*d* representing a predetermined pattern D1 such as a penguin and the ink jet printing layer 4*e* representing characters D2 (in the drawing, "AABBCC" as an example) of a manufacturer, a model, or a trademark of the hot water unit U are provided. In addition, on four corners of the cover body 3, an ink jet printing layer 4*f* representing a positioning mark D3 during press processing to be described below is provided. In the drawing, the positioning mark D3 is shown in a (+) shape, but the disclosure is not limited thereto. In addition, the positioning mark D3 may be provided on a back surface of the cover body 3 in place of or in addition to the front surface of the cover body 3.

Figure 4:
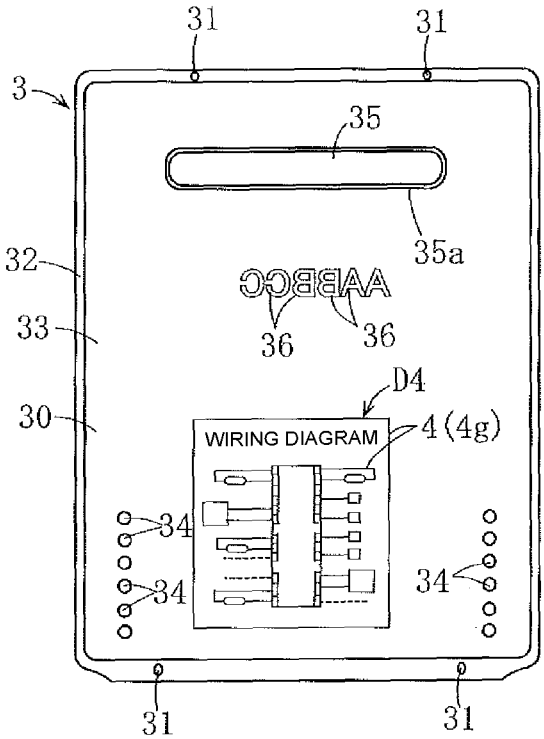
FIG. 4 is a rear view of the cover body shown in FIG. 1 and FIG. 2(*a*).

As shown in FIG. 4, on the back surface of the cover body 3, the ink jet printing layer 4*g* representing an electrical wiring diagram D4 of the hot water device 1 is further provided. In place of or in addition to the electrical wiring diagram D4, a configuration showing a piping diagram of the hot water device 1 can be used. Although illustration is omitted, on the back surface of the cover body 3, separately from the electrical wiring diagram D4 and the piping diagram, a configuration further including an ink jet printing layer representing a description of a specification of the hot water unit U, notes, etc. can be used.

Figure 6:
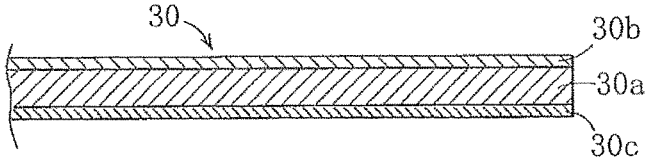
FIG. 6 is a cross-sectional view of a main part showing an example of a colored steel plate used for producing the cover body shown in FIG. 1 and FIG. 2(*a*).

As shown in FIG. 6, the colored steel plate 30 as a raw material of the cover body 3 has a multi-layer structure including a plated steel plate 30*a*, a white-type (including white) front side paint layer 30*b* laminated on a front surface of the plated steel plate 30*a*, and a back side paint layer 30*c* as a service coat laminated on a back surface of the plated steel plate 30*a*. The ink jet printing layers 4*a* to 4*e* represent the pattern D1 such as the above penguin figure and the characters D2 in a color different from that of the white series front paint layer 30*b*. A white part in FIG. 2(*a*) is a part of the front paint layer 30*b* of the colored steel plate 30 on which ink jet printing is not applied.

Basically, the entire ink jet printing layer 4*a* is formed in the same color and the same thickness. However, as shown in FIG. 3(*d*), a thickness ta of a corner 33*a*' of a peripheral wall 33*a* (a wall raised forward from the outer peripheral flange part 33) of the bulging part 33 is thinner than a thickness tb of other parts of the peripheral wall 33*a* and a thickness of a part other than the peripheral wall 33*a*. The bulging part 33 is formed in a drawing process, and the peripheral wall 33*a* corresponds to an example of a drawn part in the disclosure. However, in this drawing process, an extending amount at the corner 33*a*' of the peripheral wall 33*a* becomes the largest (the corner 33*a*' corresponds to an example of "a part whose plate thickness is thinner than other parts in the drawn part" in the disclosure). In connection with this, if the thickness ta of the ink jet printing layer 4*a* at the corner 33*a*' is set to be smaller, as will be described below, a separation prevention effect of the ink jet printing layer 4*a* can be obtained. Here, when an amount of the entire peripheral wall 33*a* drawn (an extending amount) is increased in order to increase an amount of bulging of the bulging part 33, the thickness tb of a part other than the corner 33*a*' of the peripheral wall 33 may be formed to be thinner than a thickness of other parts of the ink jet printing layer 4*a*.

While the ink jet printing layer 4*b* is provided on a part surrounding the exhaust port 35, as described with reference to FIG. 3(*c*), the exhaust port 35 is formed as a burring hole having the burring part 35*a*. On the other hand, a part of the ink jet printing layer 4*b* is also provided on an inner surface of the burring part 35*a*. Accordingly, a part surrounding the exhaust port 35 and an inner surface of the burring part 35*a* can be formed in the same color, and it is possible to improve the appearance of the exhaust port 35 and parts surrounding thereof.

The ink jet printing layer 4*e* is provided on a front surface of a step pushing part 36 (refer to FIG. 2(*b*) and FIG. 3(*b*)) three-dimensionally representing the characters D2. More specifically, the step pushing part 36 is a part in which the characters D2 are three-dimensionally shaped when a part of the colored steel plate 30 is partially extruded by press processing, and the ink jet printing layer 4*e* is provided on a front part of the step pushing part 36. As the step pushing part 36, there are a front side convex form in which a part of the colored steel plate 30 is extruded to the front side of the cover body 3 and a front side concave form in which a part of the colored steel plate 30 is extruded to the rear side of the cover body 3, but either of them may be used.

The above cover body 3 can be produced by the following processes.

Figures 5A, 5B, 5C, 5D, 5E:
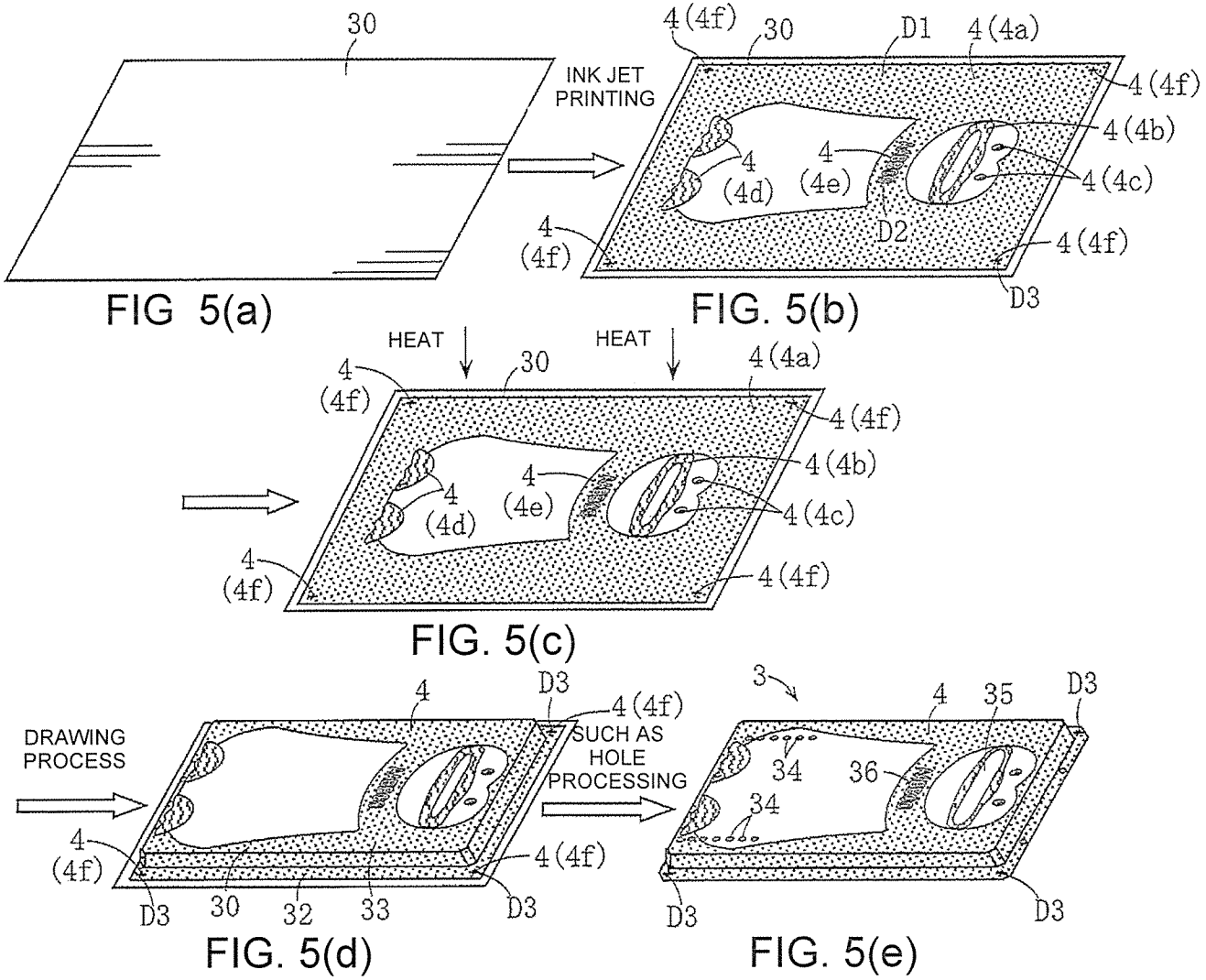
FIGS. 5(*a*) to 5(*e*) are explanatory diagrams showing a process of producing the cover body shown in FIG. 1 and FIG. 2(*a*).
Figure 7A:
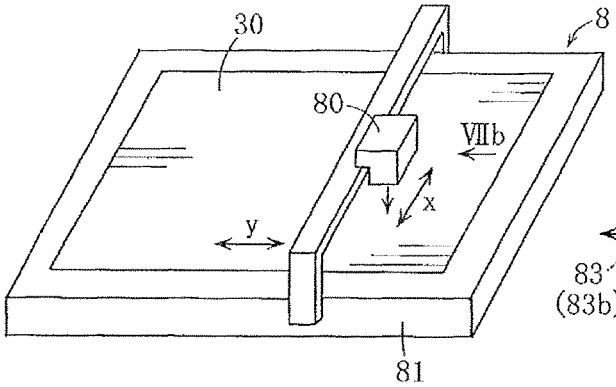
FIG. 7(*a*) is a perspective view showing an example of a schematic configuration of a printer used for ink jet printing, and FIG. 7(*b*) is a diagram when viewed in the direction of the arrow VIIb in FIG. 7(*a*) and is a diagram showing a schematic structure of a print head of the printer shown in FIG. 7(*a*).
Figure 7B:
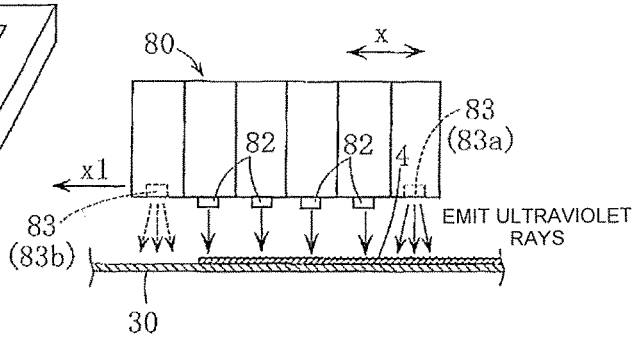

First, as shown in FIG. 5(*a*), as a raw material of the cover body 3, the flat colored steel plate 30 described with reference to FIG. 6 is prepared. Next, ink jet printing is performed on the colored steel plate 30 (strictly, on the paint layers 30*b* and 30*c* of the colored steel plate 30), and thus, as shown in FIG. 5(*b*), the ink jet printing layer 4 is provided. The ink jet printing is performed, for example, using the ink jet printer 8 shown in FIG. 7(*a*). In the ink jet printer 8, a print head 80 is freely movable in x and y directions that are orthogonal to each other on the side above a mounting table 81 on which the colored steel plate 30 is mounted and supported. As shown in FIG. 7(*b*), the print head 80 includes a plurality of ink jet nozzles 82 through which an ink jet paint in a predetermined color is made into fine droplets and sprayed toward the colored steel plate 30. This point is the same as that known in the related art, but in the present embodiment, a pair of UV light sources 83 (83*a* and 83*b*) are further provided.

For example, when ink jet printing is performed while the print head 80 is moved in an x1 direction in FIG. 7(*b*) as a main scanning direction, the UV light source 83*a* on the rear side in the main scanning direction is caused to emit light, and ultraviolet rays are emitted to an area immediately after ink jet printing is performed. Since a UV curable resin is contained in the ink jet printing layer 4, it is possible to rapidly cure (curing to a degree that bleeding to be described below does not occur) the ink jet printing layer 4 by emitting ultraviolet rays described above. Therefore, it is possible to prevent circumstances such as occurrence of bleeding due to mixing of uncured ink jet printing layers 4 with different colors. When ink jet printing proceeds in a direction opposite to the above x1 direction, the UV light source 83*b* is caused to emit light in place of the UV light source 83*a*, and thus the same actions as described above are obtained.

Here, when the ink jet printing layer 4*a* is provided, the thickness to of a part scheduled to become the corner 33*a*' of the peripheral wall 33*a* within the colored steel plate 30 shown in FIG. 3(*d*) is set to be thinner than the thickness tb of other parts.

After the above ink jet printing on both front and back surfaces of the colored steel plate 30 is completed, as shown in FIG. 5(*c*), the colored steel plate 30 is heated, the ink jet printing layer 4 is dried, and a thermosetting resin contained in the ink jet printing layer 4 is cured. This heating is performed using, for example, a heating furnace. According to such processing, it is possible to increase the strength of the ink jet printing layer 4 and impart excellent weather resistance. In addition, it is possible to provide durability in subsequent press processing.

Figure 8:
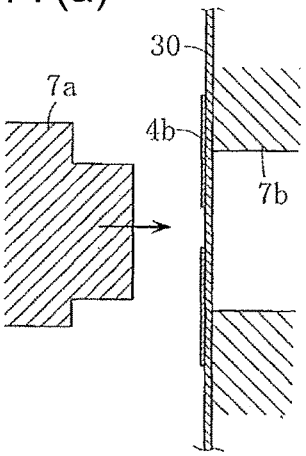
FIG. 8 is a cross-sectional view of a main part showing an example of an operational process for obtaining the structure in FIG. 3(*c*).

Next, drawing processing as press processing is performed on the above colored steel plate 30, and as shown in FIG. 5(*d*), the outer peripheral flange part 32 and the bulging part 33 are formed. Then, as shown in FIG. 5(*e*), a press process in which the air supply port 34, the exhaust port 35, the step pushing part 36, and the like are formed, a trimming process in which extra parts of the outer peripheral flange part 32 are removed, a subsequent hemming process, and the like are performed. Accordingly, it is possible to produce the above cover body 3. In the above operational process, it is possible to perform positioning of the colored steel plate 30 accurately using the positioning mark D3 as a reference. In addition, an operation of forming the exhaust port 35 is performed using, for example, a punch 7*a* and a die 7*b* as shown in FIG. 8. However, since the ink jet printing layer 4*b* is provided not only on a part surrounding a part in which the exhaust port 35 is scheduled to be formed but also on a part in which the exhaust port 35 is to be formed continuously, as shown in FIG. 3(*c*), a configuration in which the ink jet printing layer 4*b* is provided continuously from the part surrounding the exhaust port 35 to the burring part 35*a* can be appropriately realized.

Next, operations of the exterior case C including the above cover body 3 and the hot water unit U will be described.

First, since the pattern D1 such as a penguin is represented on the front part of the cover body 3, for example, compared with the cover body 3 whose front surface is formed in a single color with no pattern, it is possible to make the hot water unit U have excellent design properties. Since an inner surface of the burring part 35*a* of the exhaust port 35 is coated in continuity with a part surrounding the exhaust port 35, an external appearance is more favorable than a case in which an inside of the burring part 35*a* is formed in a color different from that of the part surrounding the burring part 35*a*. In addition, at the corner 33*a*' of the peripheral wall 33*a*, a part of the colored steel plate 30 extends greatly according to the drawing process. However, since the thickness to of the ink jet printing layer 4 at the part is made thinner than the thickness tb of other parts, it is possible to prevent a risk of the ink jet printing layer 4 being easily separated according to the above drawing process.

On the back surface of the cover body 3, since the electrical wiring diagram D4 or the piping diagram is represented on the ink jet printing layer 4*g*, it is useful for maintenance work and the like. For example, in a method of attaching a sheet on which an electrical wiring diagram is printed to the back surface of the cover body 3, there is a risk of the sheet breaking or separating from the cover body 3 and being lost. However, according to the present embodiment, there is no such a risk.

Since the coating layers representing the pattern D1, the characters D2, the positioning mark D3, and the electrical wiring diagram D4 of the cover body 3 are all set as the ink jet printing layer 4, it is possible to easily provide them using the above ink jet printer 8. For example, unlike painting using a spray system, masking processing and paint color matching are not performed, and expert skills are not required. Therefore, it is possible to improve workability and productivity. In addition, it is easy to change the design of the pattern D1 or the like, and production of small quantities of many different kinds is appropriate. Furthermore, according to ink jet printing, there is no or little waste of the ink paint, and the environmental load is also small. Since a base of the ink jet printing layer 4 is the paint layers 30*b* and 30*c* of the colored steel plate 30, it is possible to improve an appearance and weather resistance of a part in which the ink jet printing layer 4 is not provided.

Example 2

Figure 9A:
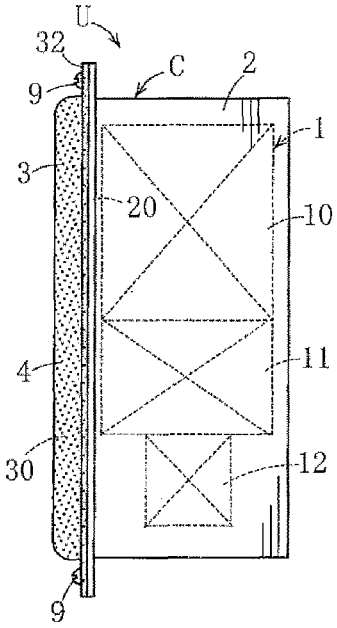
FIG. 9(*a*) is a side view showing an example of a hot water unit according to an embodiment of the disclosure and FIG. 9(*b*) is an exploded perspective view of an exterior case (when an internal hot water device is omitted) of the hot water unit shown in (a).
Figure 9B:
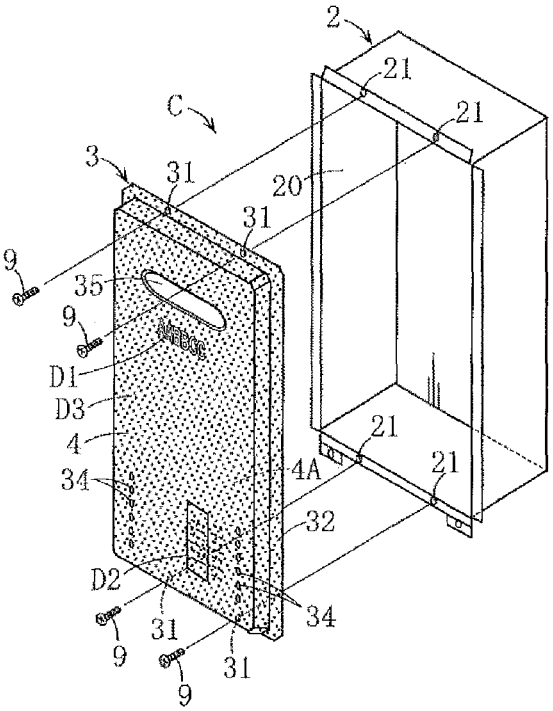

The hot water unit U shown in FIG. 9 is a water heater, and has a configuration in which the hot water device 1 for hot water production is accommodated in the exterior case C. The hot water device 1 includes the heat exchanger 10 through which hot water flows, the burner 11 configured to heat hot water in the heat exchanger 10 and the fan 12 configured to supply combustion air to the burner 11.

The exterior case C includes the rectangular box-shaped exterior case main body 2 having the opening 20 on its front surface and the cover body 3 (front cover body) for blocking the opening 20. The cover body 3 is detachably attached to a front part of the exterior case main body 2 using the screw body 9, for example, a screw, and the screw insertion holes 31 and 21 into which the screw body 9 is inserted.

The exterior case main body 2 and the cover body 3 correspond to a metal plate part in the disclosure. In the present embodiment, as will be described below, the ink jet printing layers 4 and 4A are provided on the cover body 3, but they are not provided on the exterior case main body 2. Therefore, hereinafter, a configuration of the cover body 3 will be mainly described, and the exterior case main body 2 will not be described. However, as will be described below, of course, an ink jet printing layer may be provided on the exterior case main body 2.

The cover body 3 is formed by pressing the colored steel plate 30 to be described below and has a substantially rectangular panel shape in a front view. The cover body 3 includes the outer peripheral flange part 32 for allowing surface-to-surface contact with the front part of the exterior case main body 2, the air supply port 34 through which outside air flows into the exterior case C, and the exhaust port 35 through which exhaust gas from which heat recovery by the heat exchanger 10 has been completed is discharged to the outside of the exterior case C.

The ink jet printing layer 4 is provided on a forward surface (front surface) of the cover body 3, and the ink jet printing layer 4*a* (refer to FIG. 12) is provided on a rear surface (back surface) of the cover body 3. As will be described below, the ink jet printing layers 4 and 4A are coating films provided by using the ink jet printer 8. As an ink for ink jet printing, a water-based pigment ink or a solvent-based pigment ink can be used. However, in the present embodiment, an ink containing a UV curable resin, and a thermosetting resin is used.

Figure 11:
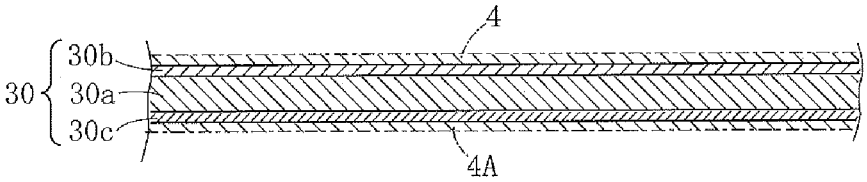
FIG. 11 is a cross-sectional view of a colored steel plate used as a material.

As shown in FIG. 11, the colored steel plate 30 used as a material of the cover body 3 has a multi-layer structure including the plated steel plate 30*a*, the front side paint layer 30*b* laminated on a front surface of the plated steel plate 30*a*, and the back side paint layer 30*c* as a base coat laminated on a back surface of the plated steel plate 30*a*.

The ink jet printing layer 4 is laminated and provided on the front side paint layer 30*b*. On the other hand, the ink jet printing layer 4*a* is laminated and provided on the back side paint layer 30*c*.

Figure 10A:
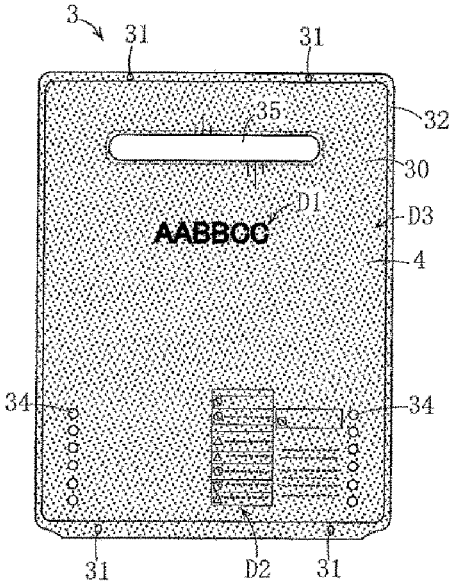
FIG. 10(*a*) is a front view of a cover body of the exterior case shown in FIG. 9 and FIG. 10(*b*) is an enlarged front view of a main part in FIG. 10(*a*).
Figure 10B:
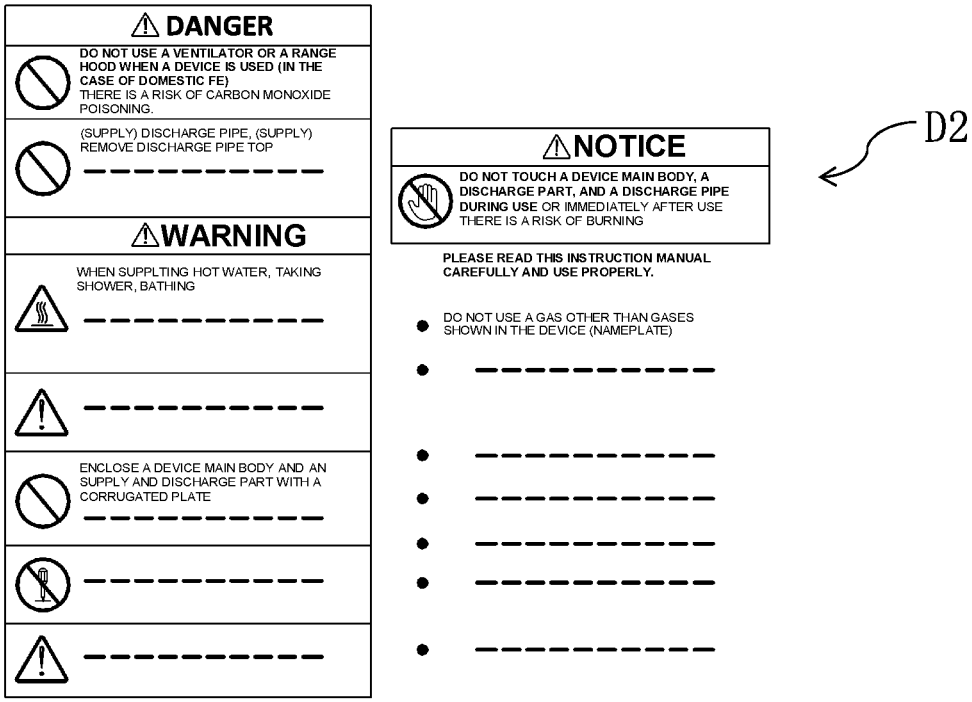

As shown clearly in FIG. 10, the ink jet printing layer 4 is provided on substantially the entire area of the front surface of the cover body 3, and has, for example, first to third areas D1 to D3. The first area D1 is an area on which, for example, a manufacturer name (including the logo) of the hot water unit U is displayed, and in the drawing, for convenience, the letters "AABBCC" are shown. The second area D2 is an area on which instructions for use of the hot water unit U are displayed, for example, a mode shown in FIG. 10(*b*). The first and second areas D1 and D2 are areas on which device related information of the hot water unit U is displayed.

The third area D3 is an area which is provided in a wide area other than the above first and second areas D1 and D2 within the front surface of the cover body 3 and on which a decoration pattern is displayed. In the drawing, for convenience, the third area D3 is shown as a dot pattern part. However, the decoration pattern displayed on the third area D3 is not limited thereto. For example, in addition to traditional patterns such as a grid pattern and a checkered pattern, it is possible to design various patterns in which animals, plants, or other appropriate motifs are scattered and arranged on a plurality of parts, or a small number of motifs are shown at a relatively large size.

Figure 12:
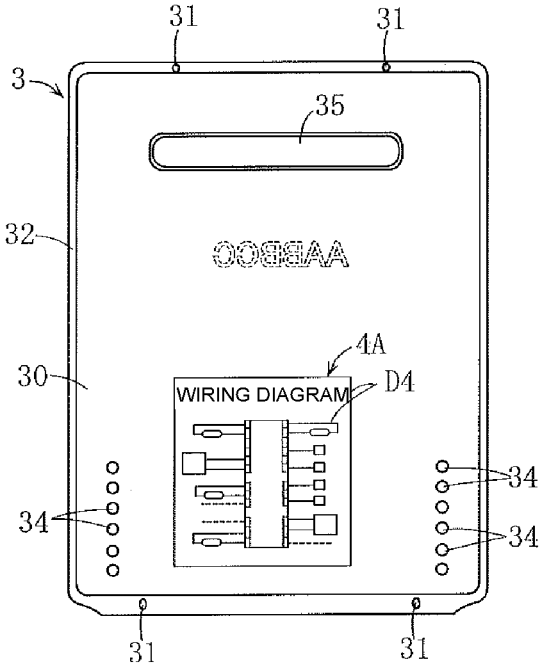
FIG. 12 is a rear view of the cover body of the exterior case shown in FIG. 9.

On the other hand, as shown in FIG. 12, the ink jet printing layer 4*a* has the fourth area D4 representing an electrical wiring diagram of the hot water unit U (strictly, the hot water device 1). Like the first and second areas D1 and D2, the fourth area D4 is an area on which device related information of the hot water unit U is displayed. On the fourth area D4, in place of or in addition to the electrical wiring diagram, the piping diagram of the hot water unit U or other diagrams for explaining installation of parts can be displayed.

The above cover body 3 can be produced by the following processes.

Figure 13A:
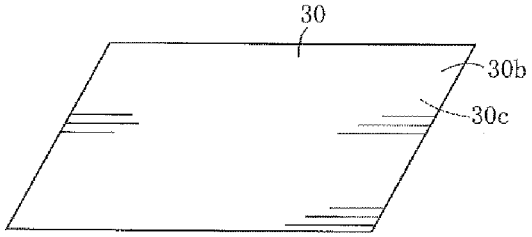
FIGS. 13(*a*) to 13(*c*) are schematic perspective views showing an example of a method of producing the cover body of the exterior case shown in FIG. 1.
Figure 13B:
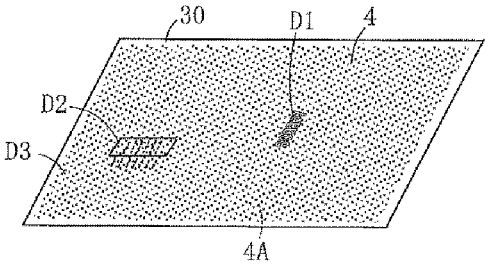
Figure 13C:
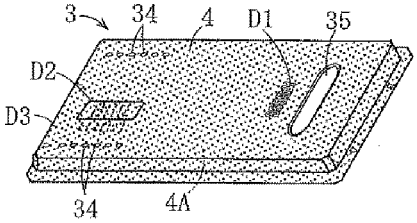

First, as shown in FIG. 13(*a*), as a raw material of the cover body 3, the flat colored steel plate 30 is prepared. Next, ink jet printing is performed on a front surface and a back surface (strictly, on the paint layers 30*b* and 30*c*) of the colored steel plate 30, and thus, as shown in FIG. 16(*b*), the ink jet printing layers 4 and 4A are provided. The ink jet printing is performed, for example, using the ink jet printer 8 shown in FIGS. 7(*a*) and 7(*b*). Since the operation and action of the ink jet printer 8 are the same as those in Example 1, related descriptions thereof will be omitted.

After the ink jet printing on the colored steel plate 30 is completed, the colored steel plate 30 is heated, the ink jet printing layers 4 and 4A are dried, and a thermosetting resin contained in the ink jet printing layers 4 and 4A is cured. This heating is performed using, for example, a heating furnace. According to such processing, it is possible to increase the strength of the ink jet printing layers 4 and 4A and impart excellent weather resistance.

Then, press processing is performed on the above colored steel plate 30, and as shown in FIG. 13(*c*), the cover body 3 is molded. Examples of the press processing include a drawing process for making the colored steel plate 30 bulge and a process of forming the air supply port 34 and the exhaust port 35.

Unlike the above series of processes, for example, when the above press processing is performed before ink jet printing is performed, it may be difficult to perform ink jet printing appropriately on an area formed in a nonplanar shape (an uneven shape, a curved surface shape, or the like) according to press processing. On the other hand, according to the series of processes, it is possible to appropriately avoid such circumstances.

Next, operations of the exterior case C and the hot water unit U described above will be described.

First, on the first to fourth areas D1 to D4 (excluding the third area D3) of the ink jet printing layers 4 and 4A, a manufacturer name and instructions for use of the hot water unit U and the electrical wiring diagram are displayed. Therefore, it is possible to eliminate or reduce time and effort for preparing a label for displaying them and attaching it to the exterior case C. When no label is used, it is possible to appropriately avoid circumstances such as a poor appearance of the hot water unit U and loss of the label due to occurrence of bubbles inside the label or peeling of the label. The electrical wiring diagram is displayed on the back surface of the cover body 3 in the present embodiment. However, in such a configuration, it is useful when the cover body 3 is removed from the exterior case main body 2 and maintenance work of the hot water device 1 is performed.

The ink jet printing layers 4 and 4A can be easily provided using the above ink jet printer 8. For example, unlike painting using a transfer system or a spray system, a transfer plate and masking processing are not performed, and paint color matching and expert skills are also not required. Therefore, it is possible to improve workability and productivity and reduce production costs. In addition, it is easy to change a design represented on the ink jet printing layer 4 and production of small quantities of many different kinds is appropriate. Further, according to ink jet printing, there is almost no waste of an ink paint and the environmental load is also small.

In addition, according to a step of providing the ink jet printing layers 4 and 4A, it is possible to finely represent small letters, complicated figures, and the like, and it is possible to form a favorable appearance. Since the ink jet printing layers 4 and 4A are provided on the paint layers 30*b* and 30*c*, it is more suitable for making letters displayed on the ink jet printing layers 4 and 4A clear. In the present embodiment, since a decorative pattern is represented in a wide range of a front surface of the cover body 3 according to the third area D3 of the ink jet printing layer 4, it is possible to further improve design properties and decoration properties of the exterior case C. Since a base of the ink jet printing layer 4 is the paint layers 30*b* and 30*c* of the colored steel plate 30, it is possible to improve an appearance and weather resistance of a part in which the ink jet printing layer 4 is not provided.

The disclosure is not limited to content of the above embodiment. Designs of specific configurations of the exterior case for a hot water unit according to the embodiments of the disclosure and respective components of the hot water unit can be variously changed within a range intended by the disclosure. Specific configurations of operational processes of a method of producing an exterior case for a hot water unit according to the embodiments of the disclosure can be variously changed.

While an example in which ink jet printing is performed only on the cover body 3 has been shown in the above embodiment, in the embodiments of the disclosure, in place of or in addition thereto, of course, ink jet printing may also be performed on the exterior case main body 2. Specific content such as letters and patterns represented on the ink jet printing layer of the embodiments of the disclosure is not limited, and at least one of letters, symbols, figures, and patterns may be represented.

In the above embodiment, device related information of the hot water unit in the embodiments of the disclosure is not limited to those exemplified in the above embodiment, but it includes, for example, a distributor name, a model, and a manufacture date of the hot water unit. In short, information that is related to the hot water unit in any aspect is device related information in the embodiments of the disclosure. In the embodiments of the disclosure, at least one of letters, symbols, figures, and patterns representing such device related information may be displayed on the ink jet printing layer.

The hot water unit according to the embodiments of the disclosure can have a configuration as a hot water storage tank unit in which a hot water device for hot water storage such as a hot water storage tank is accommodated in an exterior case in place of a configuration in which a hot water device for hot water production such as a water heater is accommodated in an exterior case. Therefore, the exterior case is not limited to a combination of an exterior case main body having a front opening and a cover body for blocking the front opening.

As a material of the exterior case, a flat metal plate is used. However, as the metal plate, a material other than commercially available colored steel plates can be used. In addition, as a material of the exterior case, a metal plate (for example, a stainless steel plate and an aluminum plate on which no paint layer is provided in advance) other than colored steel plates can be used.

What is claimed is:

1. An exterior case for a hot water unit used for accommodating a hot water device for hot water production or hot water storage therein, wherein the exterior case comprises an exterior case main body having an opening and a cover body that is attached to the exterior case main body to block the opening, the cover body has a multi-layer structure including a metal plate, and a front side paint layer laminated on a front surface of the metal plate, the cover body comprises an ink jet printing layer that is laminated and provided on the front side paint layer, and the ink jet printing layer represents at least one of letters, symbols, figures, and patterns, the cover body includes an outer peripheral flange part and a bulging part that is surrounded by the outer peripheral flange part, and a peripheral wall of the bulging part constitutes a drawing part, and a plate thickness of the metal plate of a part of the drawn part is thinner than that of other parts of the drawn part, and a thickness of the ink jet printing layer at the part of the drawn part is thinner than that of the other parts, wherein the thickness of the metal plate of the part of the drawn part is a thickness of a corner of the peripheral wall of the bulging part.

2. The exterior case for a hot water unit according to claim 1, wherein device related information of the hot water unit is displayed on the ink jet printing layer.

3. The exterior case for a hot water unit according to claim 2, wherein, in addition to the device related information, a decoration pattern is additionally displayed on the ink jet printing layer.

4. The exterior case for a hot water unit according to claim 2, wherein, as the ink jet printing layer, an ink jet printing layer on which at least one of an electrical wiring diagram and a piping diagram of the hot water unit and other diagrams for explaining installation of parts is displayed as the device related information is provided.

5. The exterior case for a hot water unit according to claim 1, wherein, as the ink jet printing layer, an ink jet printing layer which is provided on a front part of the cover body and on which at least one of a manufacturer name, a distributor name, a model, a manufacture date, and instructions for use of the hot water unit is displayed as the device related information is provided.

6. The exterior case for a hot water unit according to claim 1, wherein a burring hole having a burring part protruding from the drawn part is provided, and in the burring part, an ink jet printing layer connected to an ink jet printing layer provided on a part surrounding the burring hole is provided.

7. The exterior case for a hot water unit according to claim 1, wherein at least a part of component parts of the exterior case is a press working article, and wherein a marker for positioning when the component parts are pressed is provided in the ink jet printing layer.

8. The exterior case for a hot water unit according to claim 1, wherein the ink jet printing layer comprises a UV curable resin.

9. The exterior case for a hot water unit according to claim 1, wherein the ink jet printing layer comprises a thermosetting resin.

10. The exterior case for a hot water unit according to claim 1, wherein the peripheral wall is a wall raised forward from the outer peripheral flange part.

* * * * *